US011415932B2

(12) United States Patent
Sato et al.

(10) Patent No.: US 11,415,932 B2
(45) Date of Patent: Aug. 16, 2022

(54) IMAGE FORMING APPARATUS HAVING A PROTECTIVE MECHANISM FOR A PHOTOSENSITIVE DRUM IN A CARTRIDGE

(71) Applicant: BROTHER KOGYO KABUSHIKI KAISHA, Nagoya (JP)

(72) Inventors: Shougo Sato, Seto (JP); Kazuna Taguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/997,007

(22) Filed: Aug. 19, 2020

(65) Prior Publication Data

US 2021/0063957 A1 Mar. 4, 2021

(30) Foreign Application Priority Data

Sep. 2, 2019 (JP) ..... JP2019-159884

(51) Int. Cl.
*G03G 21/18* (2006.01)

(52) U.S. Cl.
CPC ..... *G03G 21/1832* (2013.01); *G03G 21/1853* (2013.01); *G03G 2221/1869* (2013.01)

(58) Field of Classification Search
CPC ..... G03G 21/1832; G03G 2221/1869
See application file for complete search history.

(56) References Cited

U.S. PATENT DOCUMENTS 5,561,496 A * 10/1996 Sugiura ..... G03G 21/206 29/469
6,351,620 B1 * 2/2002 Miyabe ..... G03G 21/1885 399/111
2010/0054800 A1 * 3/2010 Okabe ..... G03G 21/1832 399/114
2011/0026966 A1 2/2011 Ushiozu
2016/0154374 A1 6/2016 Hiramatsu et al.
2016/0154375 A1 6/2016 Kamizato et al.

FOREIGN PATENT DOCUMENTS

JP 2010-054837 A 3/2010
JP 2011-048347 A 3/2011
JP 2016-102987 A 6/2016
JP 2016-110133 A 6/2016

* cited by examiner

*Primary Examiner* — Victor Verbitsky
(74) *Attorney, Agent, or Firm* — Merchant & Gould P.C.

(57) ABSTRACT

An image forming apparatus having a housing, a cartridge including a photosensitive drum and a drum cover, a drawer, a first guide, and a contacting portion, is provided. The drum cover is movable with respect to the photosensitive drum between a first position, in which the drum cover covers a part of the photosensitive drum, and a second position, in which the part of the photosensitive drum is exposed. The drawer is movable with the cartridge mounted thereon between an inner position and an outer position. The first guide is configured to guide the cartridge when the drawer with the cartridge mounted thereon moves from the outer position to the inner position. The contacting portion is configured to contact the drum cover and move the drum cover from the first position to the second position in a state where the cartridge is being guided by the first guide.

12 Claims, 8 Drawing Sheets

FIG. 3A
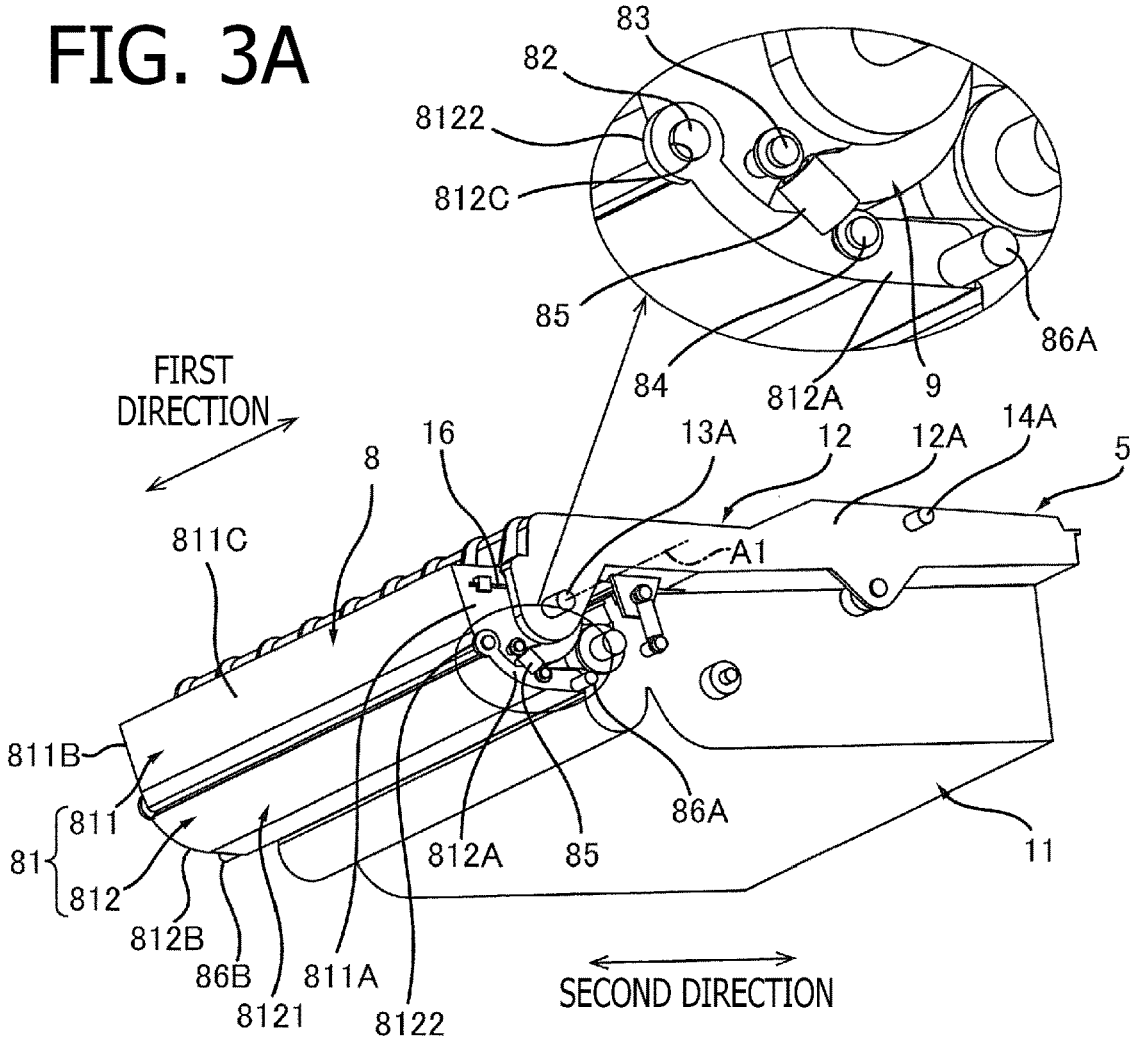
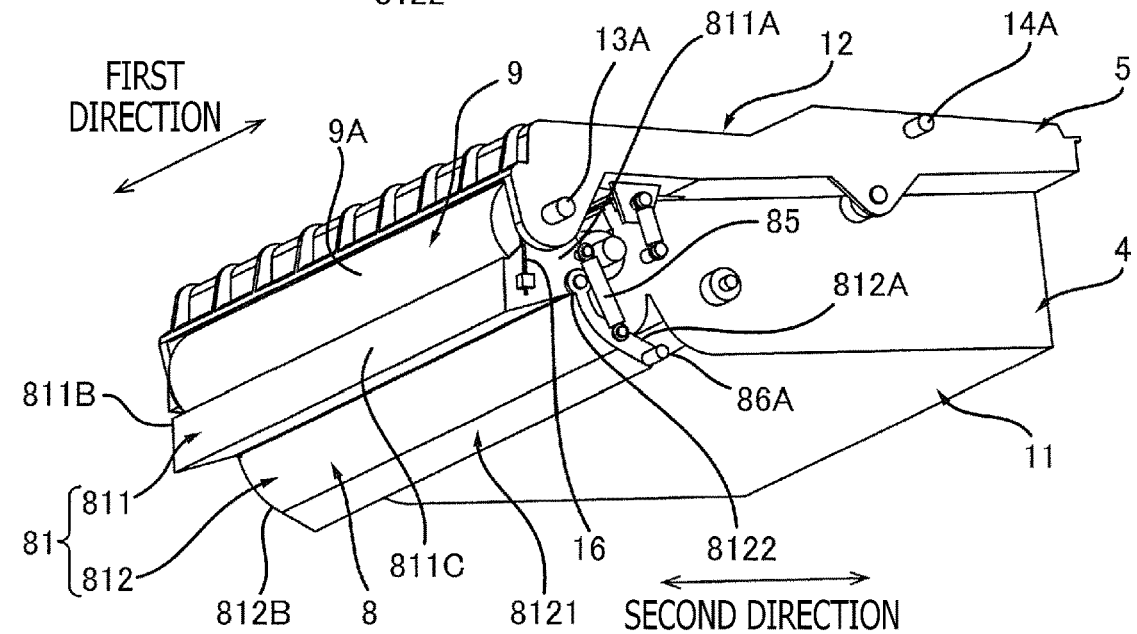
FIG. 3B

IMAGE FORMING APPARATUS HAVING A PROTECTIVE MECHANISM FOR A PHOTOSENSITIVE DRUM IN A CARTRIDGE

CROSS REFERENCE TO RELATED APPLICATION

This application claims priority under 35 U.S.C. § 119 from Japanese Patent Application No. 2019-159884, filed on Sep. 2, 2019, the entire subject matter of which is incorporated herein by reference.

BACKGROUND

Technical Field

The following description is related to an image forming apparatus.

Related Art

Image forming apparatus having a housing, a drawer, and a cartridge containing a photosensitive drum, is known. The drawer may be movable between an inner position, in which the drawer is located inside the housing, and an outer position, in which the drawer is located outside the housing. The cartridge may be detachably attached to the drawer to move along with the drawer.

SUMMARY

While the cartridge is detachable from the image forming apparatus, a user may wish to protect the photosensitive drum in the cartridge when the cartridge is detached from the image forming apparatus.

The present disclosure is advantageous in that an image forming apparatus having a cartridge, which is detachable and in which a photosensitive drum may be protected while the cartridge is removed from the image forming apparatus, is provided.

According to an aspect of the present disclosure, an image forming apparatus, having a housing, a cartridge, a drawer, a first guide, and a contacting portion, is provided. The cartridge includes a photosensitive drum rotatable about an axis, the axis extending in a first direction, and a drum cover movable with respect to the photosensitive drum between a first position, in which the drum cover covers a part of the photosensitive drum, and a second position, in which the part of the photosensitive drum is exposed. The drawer, on which the cartridge is mountable, is movable in a second direction intersecting with the first direction, between an inner position, in which the drawer is located inside the housing, and an outer position, in which the drawer is located outside the housing. The first guide is located inside the housing and is configured to guide the cartridge when the drawer with the cartridge mounted thereon moves from the outer position to the inner position. The contacting portion is located inside the housing and is configured to contact the drum cover and move the drum cover from the first position to the second position in a state where the cartridge is being guided by the first guide.

BRIEF DESCRIPTION OF THE ACCOMPANYING DRAWINGS

FIG. 3A is a perspective view of a cartridge of the image forming apparatus according to the embodiment of the present disclosure with a drum cover located at a first position. FIG. 3B is a perspective view of the cartridge of the image forming apparatus according to the embodiment of the present disclosure with the drum cover located at a second position.

DETAILED DESCRIPTION

Hereinafter, with reference to the accompanying drawings, an embodiment according to an aspect of the present disclosure will be described in detail.

1. Overall Configuration of Image Forming Apparatus 1

In the paragraphs below, with reference to FIGS. 1 and 2, described will be an overall configuration of an image forming apparatus 1.

Figure 1:
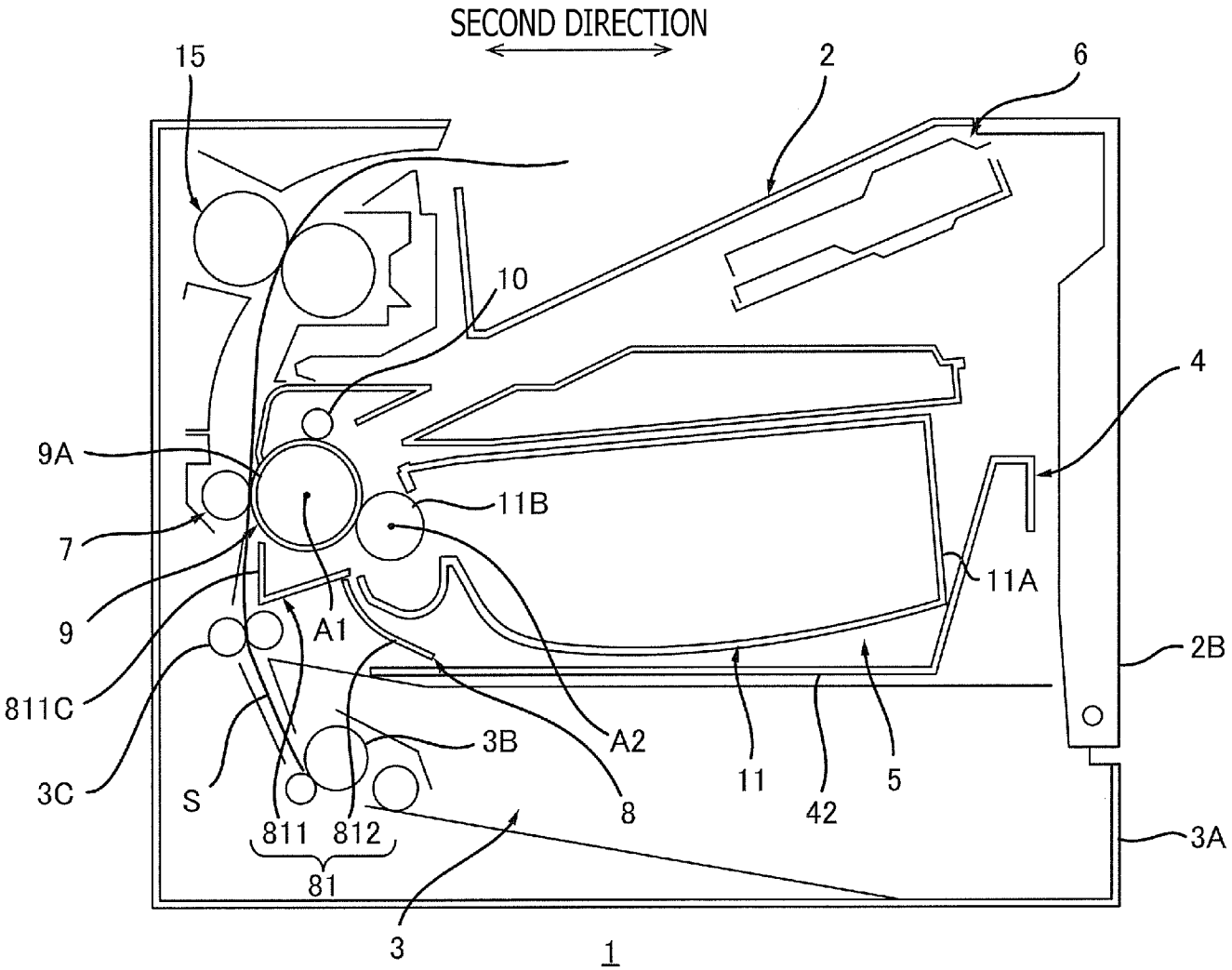
FIG. 1 is a cross-sectional overall view of an image forming apparatus according to an embodiment of the present disclosure.

As shown in FIG. 1, the image forming apparatus 1 includes a housing 2, a sheet feeder 3, a drawer 4, a cartridge 5, an exposure devise 6, a transfer roller 7, and a fuser 15. The image forming apparatus 1 may be a monochrome printing apparatus having a single cartridge 5 for printing an image in a single color.

1.1 Housing 2

The housing 2 accommodates the sheet feeder 3, the drawer 4, the cartridge 5, the exposure device 6, the transfer roller 7, and the fuser 15. The housing 2 has an opening 2A as shown in FIG. 2. The housing 2 includes a cover 2B.

Figure 2:
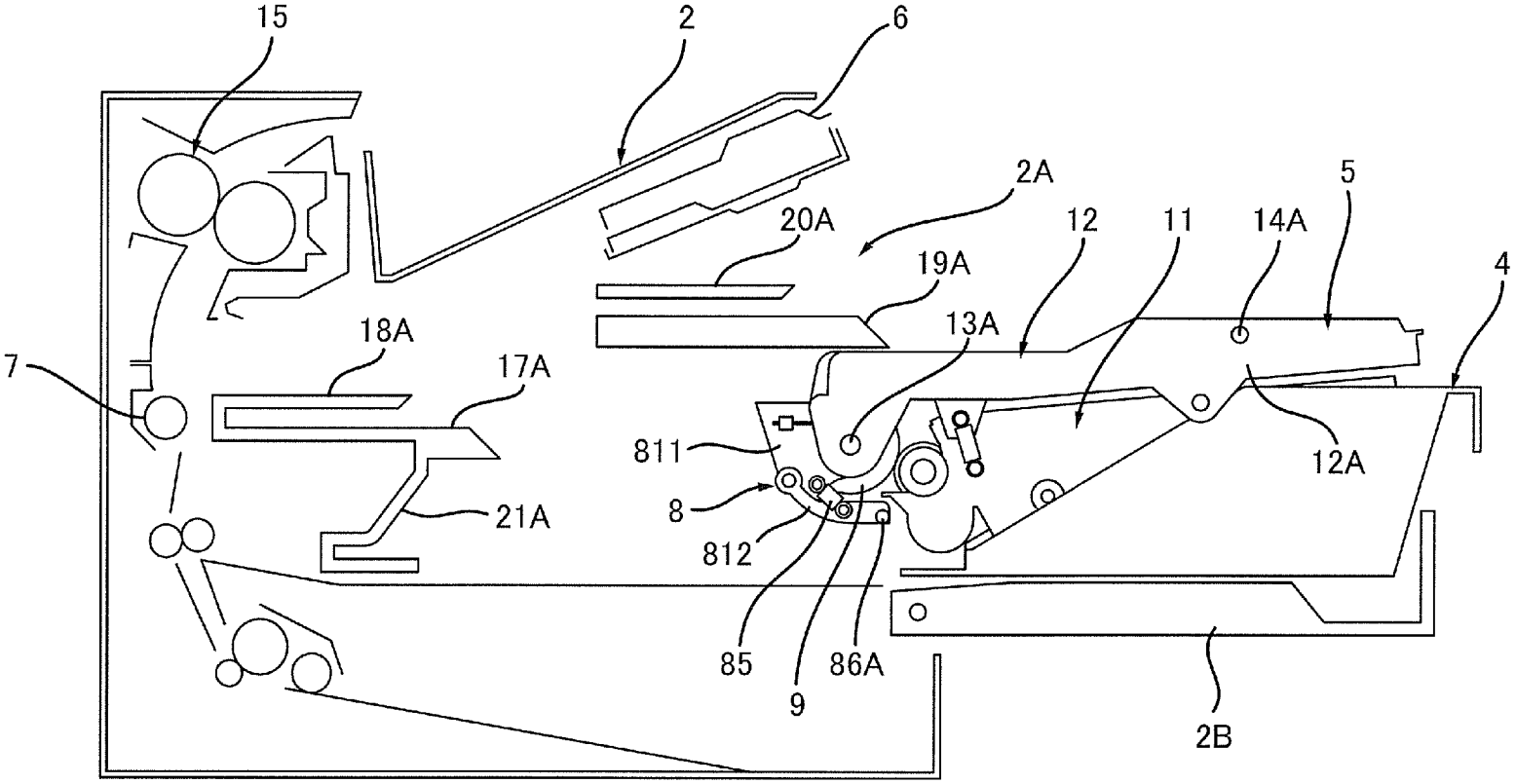
FIG. 2 is a cross-sectional view of the image forming apparatus according to the embodiment of the present disclosure with a drawer located at an outer position.

As shown in FIGS. 1 and 2, the cover 2B is movable between a closure position (see FIG. 1) and an open position (see FIG. 2). The cover 2B, when located at the closure position, closes the opening 2A and, when located at the open position, exposes the opening 2A.

1.2 Sheet Feeder 3

As shown in FIG. 1, the sheet feeder 3 may feed the sheet S to a photosensitive drum 9, which will be described further below. The sheet feeder 3 includes a sheet cassette 3A, a pickup roller 3B, and a conveyer roller 3C.

The sheet cassette 3A may accommodate one or more sheets S. The pickup roller 3B may pick up one of the sheets S from the sheet cassette 3A and convey the picked-up sheet S to the conveyer roller 3A. The conveyer roller 3C may convey the sheet S conveyed by the pickup roller 3B to the photosensitive drum 9.

1.3 Drawer 4

As shown in FIGS. 1 and 2, on the drawer 4, the cartridge 5 may be mounted. The drawer 4 is movable in a second direction, which intersects with a first direction, between an inner position (see FIG. 1) and an outer position (see FIG. 2). The first direction is a direction, in which an axis A1 of the photosensitive drum 9 extends. The second direction intersects with the first direction and with a vertical direction. The drawer 4 is movable between the inner position and the outer position with the cartridge 5 mounted thereon. The drawer 4 may move through the opening 2A to move between the inner position and the outer position. In a state where the drawer 4 is located at the inner position, the drawer 4 is entirely located inside the housing 2 (see FIG. 1). In a state where the drawer 4 is located at the outer position, at least a part of the drawer 4 is located outside the housing 2 (see FIG. 2).

1.4 Cartridge 5

As shown in FIG. 2, in a state where the drawer 4 is located at the outer position, the cartridge 5 may be mounted at a predetermined position on the drawer 4. In a state where the cartridge 5 is mounted on the drawer 4, the cartridge 5 may or may not be fixed to the drawer 4. As shown in FIG. 1, in a state where the drawer 4 with the cartridge 5 mounted thereon is located at the inner position, and the cover 2B is located at the closure position, the cartridge 5 is located between the transfer roller 7 and the cover 2B in the second direction. The cartridge 5 includes the photosensitive drum 9, a charger roller 10, and a developing device 11.

1.4.1 Photosensitive Drum 9

The photosensitive drum 9 is rotatable about the axis A1. The axis A1 extends in the first direction, which intersects with the vertical direction. Preferably, the first direction may intersect orthogonally with the second direction and with the vertical direction. The photosensitive drum 9 extends in the first direction and has a cylindrical shape. In the state where the drawer 4 with the cartridge 5 mounted thereon is located at the inner position, the photosensitive drum 9 is located between a side plate 41A (see FIG. 8) of the drawer 4 and the transfer roller 7 in the second direction. The side plate 41A will be described further below.

1.4.2 Charger Roller 10

The charger roller 10 may charge a surface of the photosensitive drum 9. The charger roller 10 is arranged to contact the surface of the photosensitive drum 9. Optionally, the cartridge 5 may have a scorotron-typed charging device in place of the charger roller 10.

1.4.3 Developing Device 11

The developing device 11 may supply toner to the photosensitive drum 9. The developing device 11 includes a developer housing 11A and a developer roller 11B. In other words, the cartridge 5 includes the developer housing 11A and the developer roller 11B.

The developer housing 11A may store the toner to be supplied to the photosensitive drum 9. The developer housing 11A supports the developer roller 11B.

The developer roller 11B is rotatable about an axis A2, which extends in the first direction. The developer roller 11B is arranged to contact the photosensitive drum 9. The developer roller 11B may supply the toner in the developer housing 11A to the photosensitive drum 9.

1.5 Exposure Device 6

In the state where the drawer 4 with the cartridge 5 mounted thereon is located at the inner position, the exposure device 6 may expose the surface of the photosensitive drum 9. For example, the exposure device 6 may be a laser scanner. The exposure device 6 may emit a laser beam at the photosensitive drum 9.

When the surface of the photosensitive drum 9 is charged by the charger roller 10, the exposure device 6 may expose the surface of the photosensitive drum 9 to the laser beam to form an electrostatic latent image on the surface of the photosensitive drum 9.

1.6 Transfer Roller 7

The transfer roller 7 is arranged to, in the state where the drawer 4 with the cartridge 5 mounted thereon is located at the inner position, contact the photosensitive drum 9. Meanwhile, the sheet S conveyed by the conveyer roller 3C may enter a position between the transfer roller 7 and the photosensitive drum 9. As the sheet S passes between the transfer roller 7 and the photosensitive drum 9, the transfer roller 7 may transfer a toner image formed on the surface of the photosensitive drum 9 to the sheet S.

1.7 Fuser 15

The fuser 15 may apply heat and pressure to the sheet S having the transferred toner image to fuse and fix the toner image on the sheet S. The sheet S exiting the fuser 15 may be discharged outside the housing 2.

2. Detailed Configuration of the Cartridge 5

Next, with reference to FIGS. 1-4, the cartridge 5 will be described in detail.

As shown in FIGS. 3A-3B, the cartridge 5 includes, further to the photosensitive drum 9, the charger roller 10 (see FIG. 1), and the developing device 11 described above, a cartridge housing 12, a first guided portion 13A, a first guided portion 13B (see FIG. 4), a second guided portion 14A, a second guided portion 14B (see FIG. 4), a drum cover 8, and a spring 16.

2.1 Cartridge Housing 12

The cartridge housing 12 supports the photosensitive drum 9, the charger roller 10 (see FIG. 1), and the drum cover 8.

Figure 4:
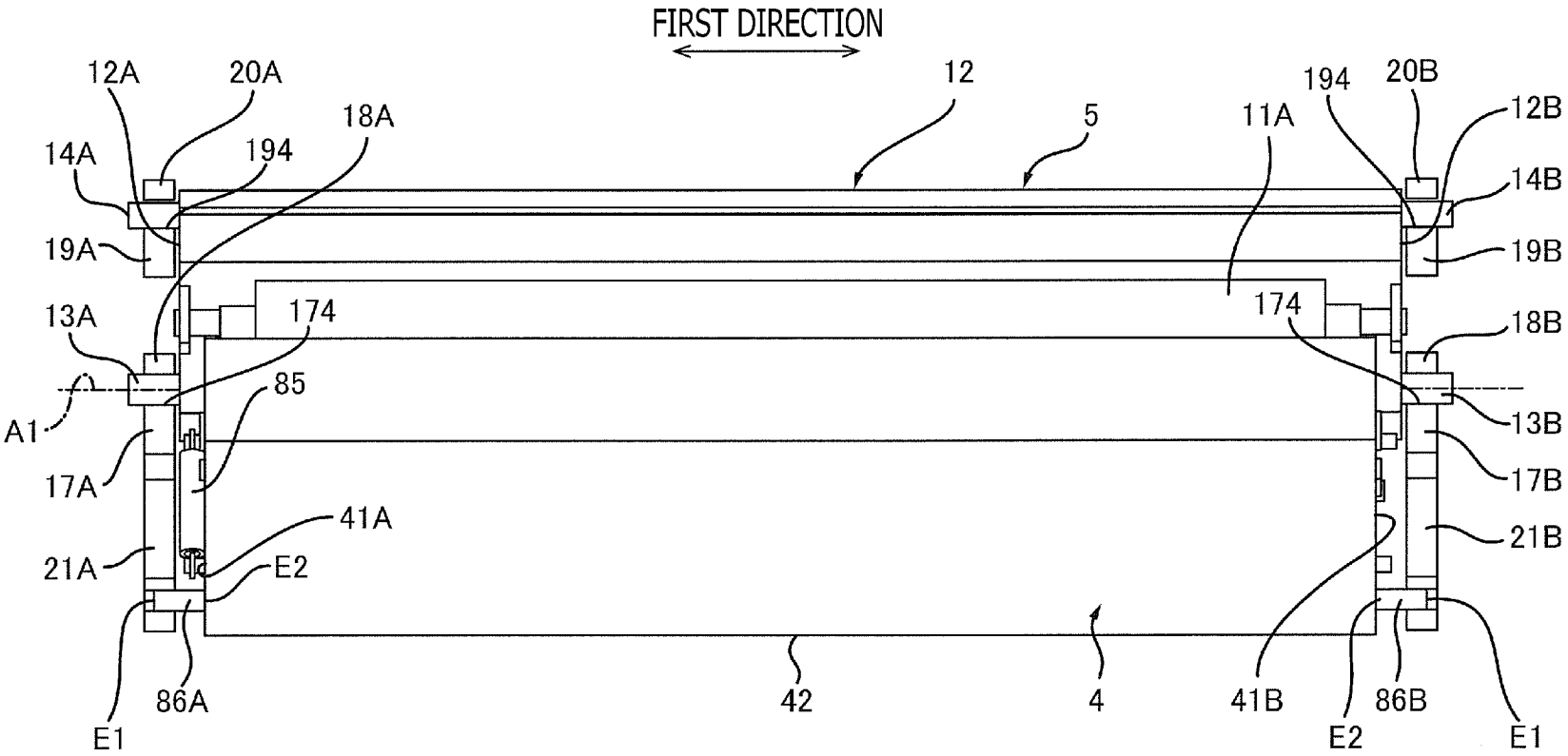
FIG. 4 is a front view of the drawer according to the embodiment of the present disclosure when the drawer with the cartridge mounted thereon is located at the inner position.

As shown in FIG. 4, the cartridge housing 12 extends in the first direction. The cartridge housing 12 has a first end and a second end, which are on one end and the other end in the first direction. The second end is located apart from the first end in the first direction. The cartridge housing 12 includes a first side plate 12A and a second side plate 12B.

The first side plate 12A is located on the first end of the cartridge housing 12. The first side plate 12A extends in a direction intersecting with the axis A1. Preferably, the first side plate 12A may extend in a direction intersecting orthogonally with the axis A1.

The second side plate 12B is located apart from the first side plate 12A in the first direction. The second side plate 12B is located at the second end of the cartridge housing 12 in the first direction. The form of the second side plate 12B may be described in the same manner as the first side plate 12A.

2.2 First Guided Portions 13A, 13B and Second Guided Portions 14A, 14B The first guided portion 13A is guided by a first guide 17A, which will be described further below, when the drawer 4 with the cartridge 5 mounted thereon moves between the inner position and the outer position. The first guided portion 13A is located on a side of the first side plate 12A opposite to the second side plate 12B in the first direction. The first guided portion 13A extends to protrude from the first side plate 12A in the first direction. In other words, the first guided portion 13A is a protrusion. Optionally, the first guided portion 13A may be attached to the first side plate 12A. The first guided portion 13A extends along the axis A1. The first guided portion 13A may have a cylindrical shape. Optionally, the first guided portion 13A may support an end of the photosensitive drum 9 therein.

The first guided portion 13B is guided by a first guide 17B, which will be described further below, when the drawer 4 with the cartridge 5 mounted thereon moves between the inner position and the outer position. The first guided portion 13B is located on a side of the second side plate 12B opposite to the first side plate 12A in the first direction. The first guided portion 13B extends from the second side plate 12B in the first direction. The form of first guided portion 13B may be described in the same manner as the first guided portion 13A.

The second guided portion 14A is guided by a second guide 19A, which will be described further below, when the drawer 4 with the cartridge 5 mounted thereon moves between the inner position and the outer position. The second guided portion 14A is located on a side of the first side plate 12A opposite to the second side plate 12B in the first direction.

As shown in FIG. 3A, the second guided portion 14A is located apart from the first guided portion 13A in the second direction. The second guided portion 14A extends to protrude from the first side plate 12A in the first direction. In other words, the second guided portion 14A is a protrusion. Optionally, the second guided portion 1A may be attached to the first side late 12A. The second guided portion 14A may have a cylindrical shape.

The second guided portion 14B as shown in FIG. 4 is guided by a second guide 19B, which will be described further below, when the drawer 4 with the cartridge 5 mounted thereon moves between the inner position and the outer position. The second guided portion 14B is located on a side of the second side plate 12B opposite to the first side plate 12A in the first direction. The second guided portion 14B extends from the second side plate 12B in the first direction. The form of second guided portion 14B may be described in the same manner as the second guided portion 14A.

2.3 Drum Cover 8

As shown in FIGS. 3A-3B, the drum cover 8 is movable with respect to the photosensitive drum 9 between a first position (see FIG. 3A) and a second position (see FIG. 3B).

As shown in FIG. 3A, the drum cover 8 may be located at the first position in a state where the cartridge 5 is detached from the drawer 4. Moreover, the drum cover 8 is located at the first position in a state where the drawer 4 with the cartridge 5 mounted thereon is located at the outer position (see FIG. 2). In the state where the drum cover 8 is located at the first position, the drum cover 8 covers a part 9A (see FIG. 3B) of the photosensitive drum 9. In this arrangement, the drum cover 8 may protect the photosensitive drum 9.

As shown in FIG. 3B, the drum cover 8 may be located at the second position in the state where the drawer 4 with the cartridge 5 mounted thereon is located at the inner position (see FIG. 1). In the state where the drum cover 8 is located at the second position, the part 9A of the drum cover 9 may be exposed. The photosensitive drum 9 may be located inside the housing 2 with the part 9A being exposed, as shown in FIG. 1. While the drum cover 8 is located at the second position, and even though the part 9A of the photosensitive drum 9 is exposed, the exposed part 9A of the photosensitive drum 9 may be protected by the housing 2. In the state where the drawer 4 with the cartridge 5 mounted thereon is located at the inner position, the part 9A of the photosensitive drum 9 may contact the transfer roller 7.

As shown in FIGS. 1-2, when the drawer 4 with the cartridge 5 mounted thereon moves from the inner position to the outer position, the drum cover 8 may move from the second position to the first position. Thus, in the state where the drawer 4 is located at the outer position, the drum cover 8 may be reliably located at the first position. Therefore, in the state where the cartridge 5 is detached from the drawer 4 located at the outer position, the drum cover 8 may protect the photosensitive drum 9 reliably.

As shown in FIG. 3A, the drum cover 8 includes a cover body 81, a first shaft 82, a second shaft 83, a third shaft 84, a spring 85, a protrusion 86A, and a protrusion 86B.

2.3.1 Cover Body 81

The cover body 81 extends in the first direction. The cover body 81 includes a first cover 811 and a second cover 812.

2.3.1.1 First Cover 811

The first cover 811 may cover the part 9A of the photosensitive drum 9 in the state where the drum cover 8 is located at the first position. The first cover 811 is located below the photosensitive drum 9 in the state where the drawer 4 with the cartridge 5 mounted thereon is located at the inner position and the drum cover 8 is located at the second position (see FIG. 1).

The first cover 811 is supported by the cartridge housing 12. The first cover 811 is rotatable with respect to the cartridge housing 12. For example, the first cover 811 may be supported by the first side plate 12A and the second side plate 12B (see FIG. 4). The first cover 811 is located between the first side plate 12A and the second side plate 12B in the first direction (see FIG. 4). The first cover 811 has a first end and a second end, which are on one end and the other end in the first direction. The second end is located apart from the first end in the first direction. The first cover 811 includes a first plate 811A, a second plate 811B, and a third plate 811C.

The first plate 811A is located on the first end of the first cover 81 in the first direction. The first plate 811A extends in a direction intersecting with the axis A1. Preferably, the first plate 811A may extend in a direction intersecting orthogonally with the axis A1. The first plate 811A is supported rotatably by the first side plate 12A.

The second plate 811 is located apart from the first plate 811 in the first direction. The second plate is located on the second end of the first cover 8 in the first direction. The second plate 811B is supported rotatably by the second side plate 12B (see FIG. 4). The form of second plate 811B may be described in the same manner as the first plate 811A.

The third plate 811C is located between the first plate 811A and the second plate 811B in the first direction. The third plate 811C may have a cross-sectional shape of an L (see FIG. 1). The third plate 811C extends in the first direction. A first end of the third plate 811 in the first direction is connected to the first plate 811A. A second end of the third plate 811C in the first direction is connected to the second plate 811B.

2.3.1.2 Second Cover 812

The second cover 812 may, in the state where the drum cover 8 is located at the first position, and while the first cover 811 covers the part 9A of the photosensitive drum 9, cover another part of the photosensitive drum 9. As shown in FIG. 1, in the state where the drum cover 8 is located at the second position, the second cover 812 is located between the cartridge 5 and a bottom plate 42 of the drawer 4. In other words, a part of the drum cover 8 located at the second position is, in the state where the drawer 4 with the cartridge 5 mounted thereon is located at the inner position, located between the cartridge 5 and the bottom plate 42. Thus, when the drawer 4 with the cartridge 5 mounted thereon is located at the inner position, a space between the bottom plate 42 of the drawer 4 and the photosensitive drum 9 may be used to accommodate the part of the drum cover 8 while the drum cover 8 is located at the second position. Therefore, a volume of the image forming apparatus 1 may be restrained from increasing. The bottom plate 42 will be described further below.

As shown in FIG. 3A, the second cover 812 is rotatably supported by the first cover 811. The second cover 812 includes a plate 8121 and a coupling portion 8122.

The plate 8121 extends in the first direction and has a cross-sectional shape of an arc. The plate 8121 has a first end portion 812A and a second end portion 812B, which are on one end and the other end in the first direction. The second end portion 812B is located apart from the first end portion 812A in the first direction.

The coupling portion 8122 protrudes from the first end portion 812A in a direction intersecting orthogonally with the first direction. The coupling section 8122 is located on a side of the first plate 811A opposite to the second plate 811B. The coupling portion 8122 has a hole 812C.

2.3.2 First Shaft 82

The first shaft 82 is supported by the first cover 811. The first shaft 82 is located on a side of the first plate 811A opposite to the second plate 811B in the first direction. The first shaft 82 extends from the first plate 811A in the first direction. Optionally, the first shaft 8 may be attached to the first plate 811A. The first shaft 82 is inserted in the hole 812C in the coupling portion 8112 of the second cover 812. Through the first shaft 82 and the hole 812C, the second cover 812 is coupled to the first cover 811.

2.3.3 Second Shaft 83 and Third Shaft 84

The second shaft 83 is supported by the first cover 811. The second shaft 83 is located on a side of the first plate 811A opposite to the second plate 811B in the first direction. The second shaft 83 is located apart from the first shaft 82. The second shaft 83 extends from the first plate 811A in the first direction. Optionally, the second shaft 83 may be attached to the first plate 811A.

The third shaft 84 is supported by the second cover 812. The third shaft 84 is located on a side of the first end portion 812A opposite to the second end portion 812B in the first direction. The third shaft 84 is located apart from the coupling portion 8122. The third shaft 84 extends from the first end portion 812A in the first direction. Optionally, the third shaft 84 may be attached to the first end portion 812A.

2.3.4 Spring 85

The spring 85 may contract in a direction to pull the plate 8121 toward the first cover 811. One end of the spring 85 is attached to the shaft 83, and the other end of the spring 85 is attached to the third shaft 84.

2.3.5 Protrusions 86A, 86B

The protrusion 86A and the protrusion 86B are located on one end and the other end of the cover body 81 in the first direction. In particular, the protrusion 86A may be located on the first end portion 812A of the second cover 812, and the protrusion 86B may be located on the second end portion 812B of the second cover 812.

The protrusion 86A is located on a side of the first end portion 812A opposite to the second end portion 812B in the first direction. The protrusion 86A is located on a side of the third shaft 84 opposite to the coupling portion 8122. The protrusion 86A extends from the first end portion 812A in the first direction. Optionally, the protrusion 86A may be attached to the first end portion 812A. The protrusion 86A may have a cylindrical shape.

As shown in FIG. 4, the protrusion 86A contacts a contacting portion 21A, which will be described further below. The protrusion 86A has a tip end E1 and a basal end E2, which are on one end and the other end the first direction. The tip end E1 is located apart from the basal end E2 in the first direction. The tip end E1 is a free end, and the basal end E2 is connected to the first end portion 812A of the plate 812 (see FIG. 3A).

The protrusion 86B contacts a contacting portion 21B, which will be described further below. The protrusion 86B extends from the second end portion 812B of the plate 812 (see FIG. 3A) in the first direction. The form of the protrusion 86B may be described in the same manner as the protrusion 86A.

2.4 Spring 16

As shown in FIGS. 3A and 3B, the spring 16 may contract to pull the drum cover 8 from the second position toward the first position. One end of the spring 16 is attached to the first plate 811A of the first cover 811. The other end of the spring 16 is, although not shown in the drawings, attached to the cartridge housing 12.

In this arrangement, the drum cover 8 may be stably located at the first position in the state where the cartridge 5 is detached from the drawer 4. In other words, the drum cover 8 may protect the photosensitive drum 9 securely while the cartridge 5 is detached from the drawer 4.

3. Detailed Configuration of Drawer 4

Next, the drawer 4 will be described in detail with reference to FIG. 4.

As shown in FIG. 4, the drawer 4 includes a side plate 41A, a side plate 41B, and the bottom plate 42.

3.1 Side Plates 41A, 41B

Figure 5:
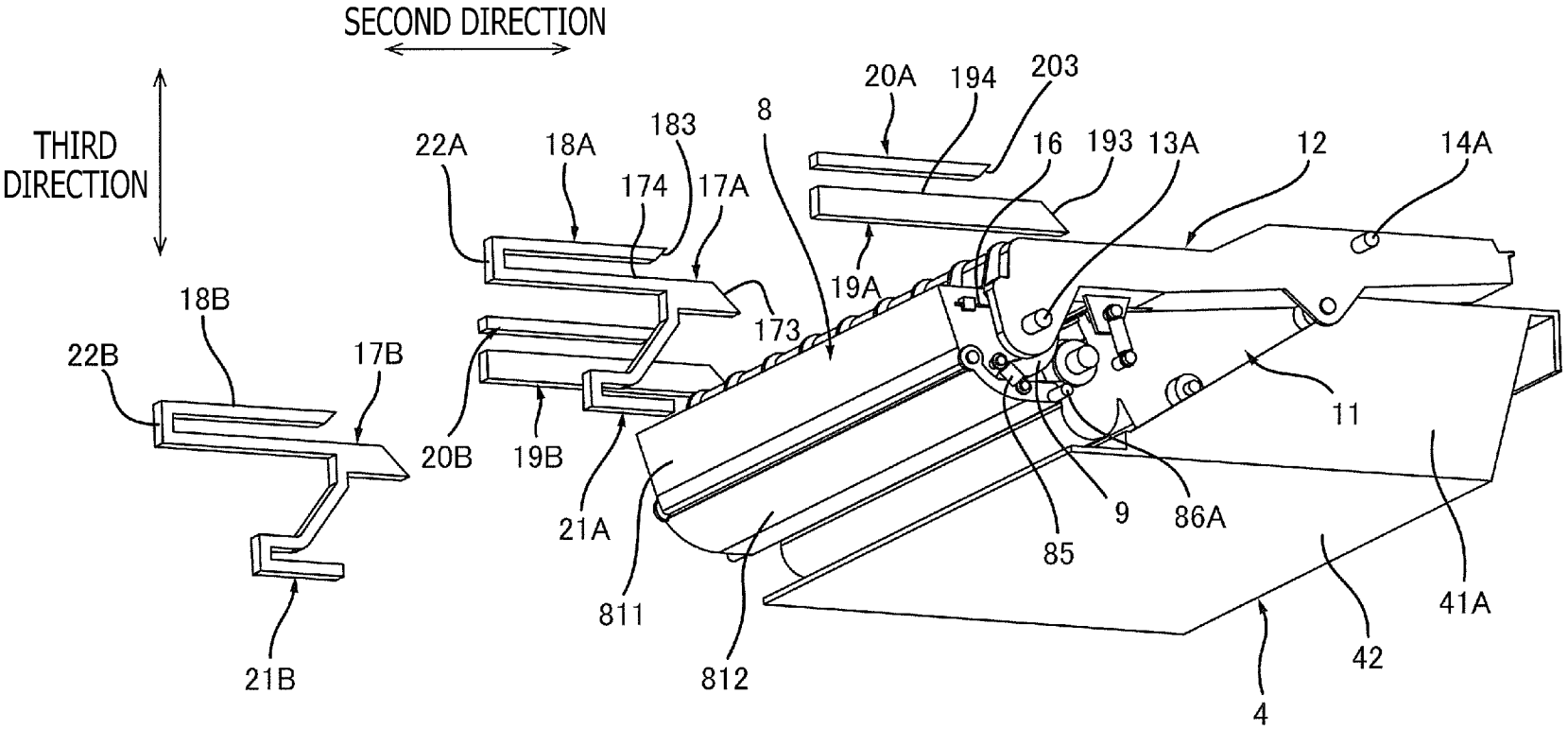
FIG. 5 is a perspective view of the drawer with the cartridge mounted thereon according to the embodiment of the present disclosure located at the outer position.

The side plate 41A and the side plate 41B extend in the second direction (see FIG. 5). The side plate 41A is, in the state where the cartridge 5 is mounted on the drawer 4, located on a side of the developer housing 11A opposite to the side plate 41B in the first direction. The side plate 41A is, in the state where the cartridge 5 is mounted on the drawer 4, located between the developer housing 11A and the tip end E1 of the protrusion 86A in the first direction. The side plate 41B is, in the state where the cartridge 5 is mounted on the drawer 4, located between the developer housing 11A and the tip end E1 of the protrusion 86B.

In other words, the tip end E1 of the protrusion 86A is located on a side of the side plate 41A opposite to the developer housing 11A in the first direction; therefore, the tip end E1 of the protrusion 86A may be placed to contact the contacting portion 21A reliably. Meanwhile, the tip end E1 of the protrusion 86B is located on a side of the side plate 41B opposite to the developer housing 11A in the first direction; therefore, the tip end E1 of the protrusion 86B may be placed to contact the contacting portion 21B reliably.

3.2 Bottom Plate 42

The bottom plate 42 is located between the side plate 41A and the side plate 41B in the first direction. The bottom plate 42 extends in the first direction. A first end being one end of the bottom plate 42 in the first direction is connected to the side plate 41A. A second end being the other end of the bottom plate 42 in the first direction is connected to the side plate 41B.

4. Detailed Configuration of Image Forming Apparatus 1

Next, with reference to FIGS. 4-8, the image forming apparatus 1 will be described in detail.

As shown in FIG. 5, the image forming apparatus 1 includes a first guide 17A, a first guide 17B, a first stopper 18A, a first stopper 18B, an abutting portion 22A, an abutting portion 22B, a second guide 19A, a second guide 19B, a second stopper 20A, a second stopper 20B, the contacting portion 21A, and the contacting portion 21B.

4.1 First Guides 17A, 17B

Figure 6:
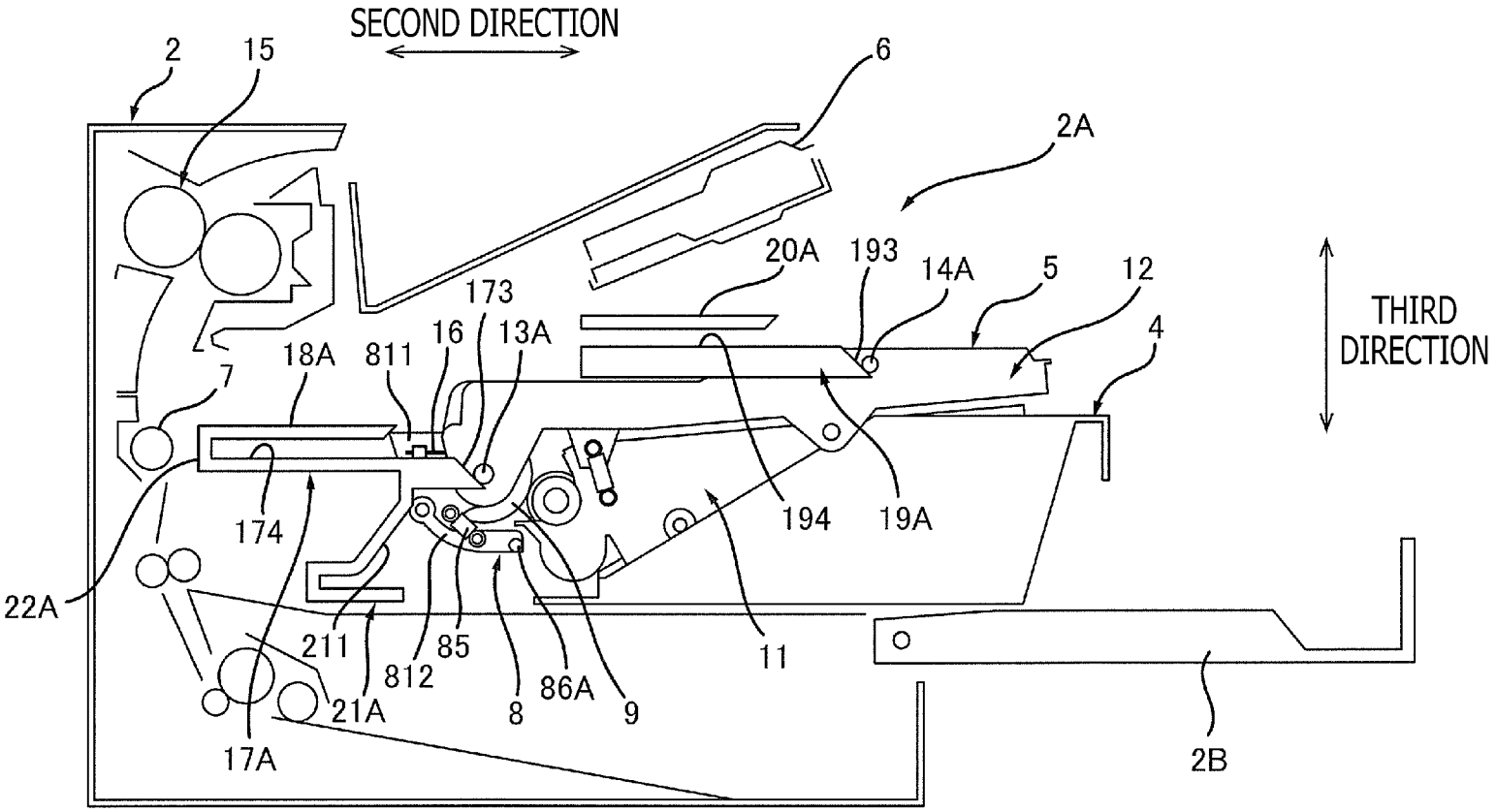
FIG. 6 is a cross-sectional view of the drawer in the image forming apparatus according to the embodiment of the present disclosure with the cartridge mounted thereon located at a position where a first guided portion contacts a first guiding face of a first guide.
Figure 7:
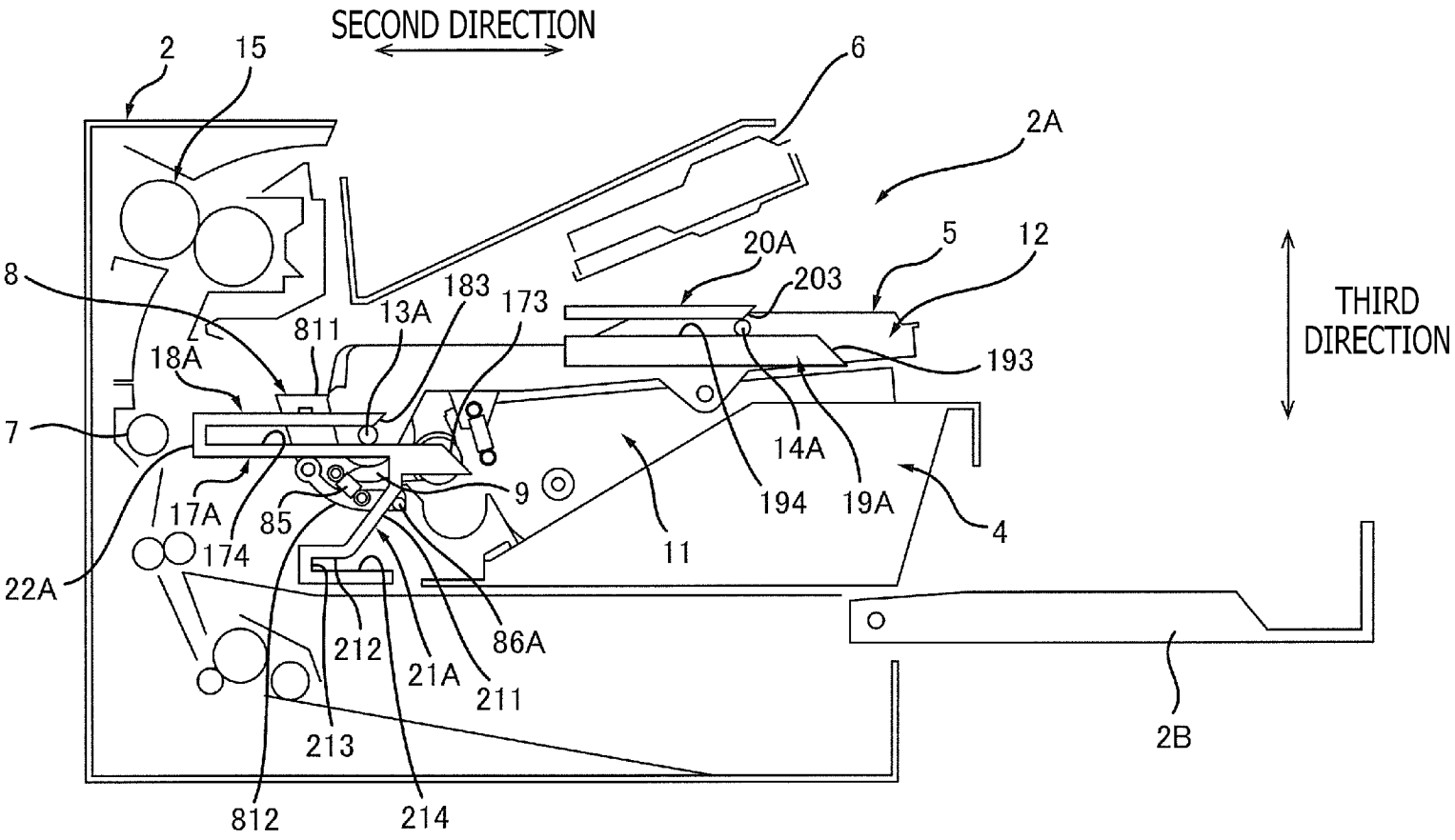
FIG. 7 is a cross-sectional view of the drawer in the image forming apparatus according to the embodiment of the present disclosure with the cartridge mounted thereon located at a position where the first guided portion contacts a second guiding face of the first guide.

The first guide 17A and the first guide 17B are located inside the housing 2. As shown in FIGS. 6 and 7, the first guide 17A and the first guide 17B (see FIG. 5) may guide the cartridge 5 when the drawer 4 with the cartridge 5 mounted thereon moves from the outer position to the inner position.

In particular, the first guide 17A may guide the first guided portion 13A when the drawer 4 with the cartridge 5 mounted thereon moves from the outer position to the inner position. The first guide 17A extends in the second direction. The first guide 17A has a first guiding face 173 and a second guiding face 174.

As shown in FIG. 6, the first guiding face 173 is located at an end of the first guide 17A in the second direction. The first guiding face 173 is located on a side of the second guiding face 174 opposite to the transfer roller 7 in the second direction. The first guiding face 173 is located apart from the abutting portion 22A in the second direction. The first guiding face 173 may, when the drawer 4 with the cartridge 5 mounted thereon moves from the outer position to the inner position, contact the first guided portion 13A and guide the first guided portion 13A to the second guiding face 174. The first guiding face 173 inclines with respect to the second direction. In particular, the first guiding face 173 inclines upward as the first guiding face 173 extends toward the second guiding face 174.

As shown in FIG. 7, the second guiding face 174 adjoins the first guiding face 173 in the second direction. The second guiding face 174 is continuous with the first guiding face 173. The second guiding face 174 extends in the second direction. The second guiding face 174 may be an upward face of the first guide 17A. The second guiding face 174 may, when the drawer 4 with the cartridge 5 mounted thereon moves from the outer position to the inner position, guide the first guided portion 13A to the abutting portion 22A. The second guiding face 174 may contact the first guided portion 13A from a lower position when the drawer 4 with the cartridge 5 mounted thereon moves from the outer position to the inner position.

Thus, when the user moves the drawer 4 with the cartridge 5 mounted thereon from the outer position to the inner position, the first guided portion 13A may be placed on and contact the second guiding face 174 stably with use of the weight of the drawer 4 and the cartridge 5. Therefore, the drawer 4 with the cartridge 5 mounted thereon may be moved smoothly.

The first guide 17B as shown in FIG. 4 may guide the first guided portion 13B when the drawer 4 with the cartridge 5 mounted thereon moves from the outer position to the inner position. The first guide 17B is located apart from the first guide 17A in the first direction. The form of the first guide 17B may be described in the same manner as the first guide 17A.

4.2 First Stoppers 18A, 18B

The first stopper 18A and the first stopper 18B are located inside the housing 2. As shown in FIG. 7, the first stopper 18A and the first stopper 18B (see FIG. 5) may, when the drum cover 8 contacts the contacting portion 21A and the contacting portion 21B (see FIG. 5), restrict the cartridge 5 from derailing, or separating from, the first guide 17A and from the first guide 17B (see FIG. 5), respectively.

Thus, the cartridge 5 may be guided reliably by the first guide 17A and the first guide 17B, and the drum cover 8 may be restrained from separating from the contacting portion 21A or the contacting portion 21B.

In particular, the first stopper 18A may, when the drawer 4 with the cartridge 5 mounted thereon moves from the outer position to the inner position, stop the first guided portion 13A from separating from the first guide 17A. The first stopper 18A is, when the drawer 4 with the cartridge 5 mounted thereon moves from the outer position to the inner position, located on a side of the first guided portion 13A opposite to the first guide 17A while the first guided portion 13A is in contact with the second guiding face 174. The first stopper 18A is located apart from the second guiding face 174 in a third direction, which intersects orthogonally with both the first direction and the second direction. A distance between the second guiding face 174 and the first stopper 18A in the third direction may be equal to an outer diameter of the first guided portion 13A. The first stopper 18A may face the second guiding face 174 from an upper position.

The first stopper 18A extends in the second direction. The first stopper 18A has a first oblique face 183, which is located at an end of the first stopper 18A in the second direction. The first oblique face 183 is located between the first guiding face 173 and the abutting portion 22A in the second direction. The first oblique face 183 inclines with respect to the second direction. The first oblique face 183 inclines downward as the first oblique face 183 extends toward the abutting portion 22A in the second direction.

The first stopper 18B as shown in FIG. 4 may, when the drawer 4 with the cartridge 5 mounted thereon moves from the outer position to the inner position, stop the first guided portion 13B from separating from the first guide 17B. The first stopper 18B is, when the drawer 4 with the cartridge 5 mounted thereon moves from the outer position to the inner position, located on a side of the first guided portion 13B opposite to the first guide 17B while the first guided portion 13B is in contact with the second guiding face 174. The first stopper 18B is located apart from the first stopper 18A in the first direction. The form of the first guide 17B may be described in the same manner as the first guide 17A.

4.3 Abutting Portions 22A, 22B

Figure 8:
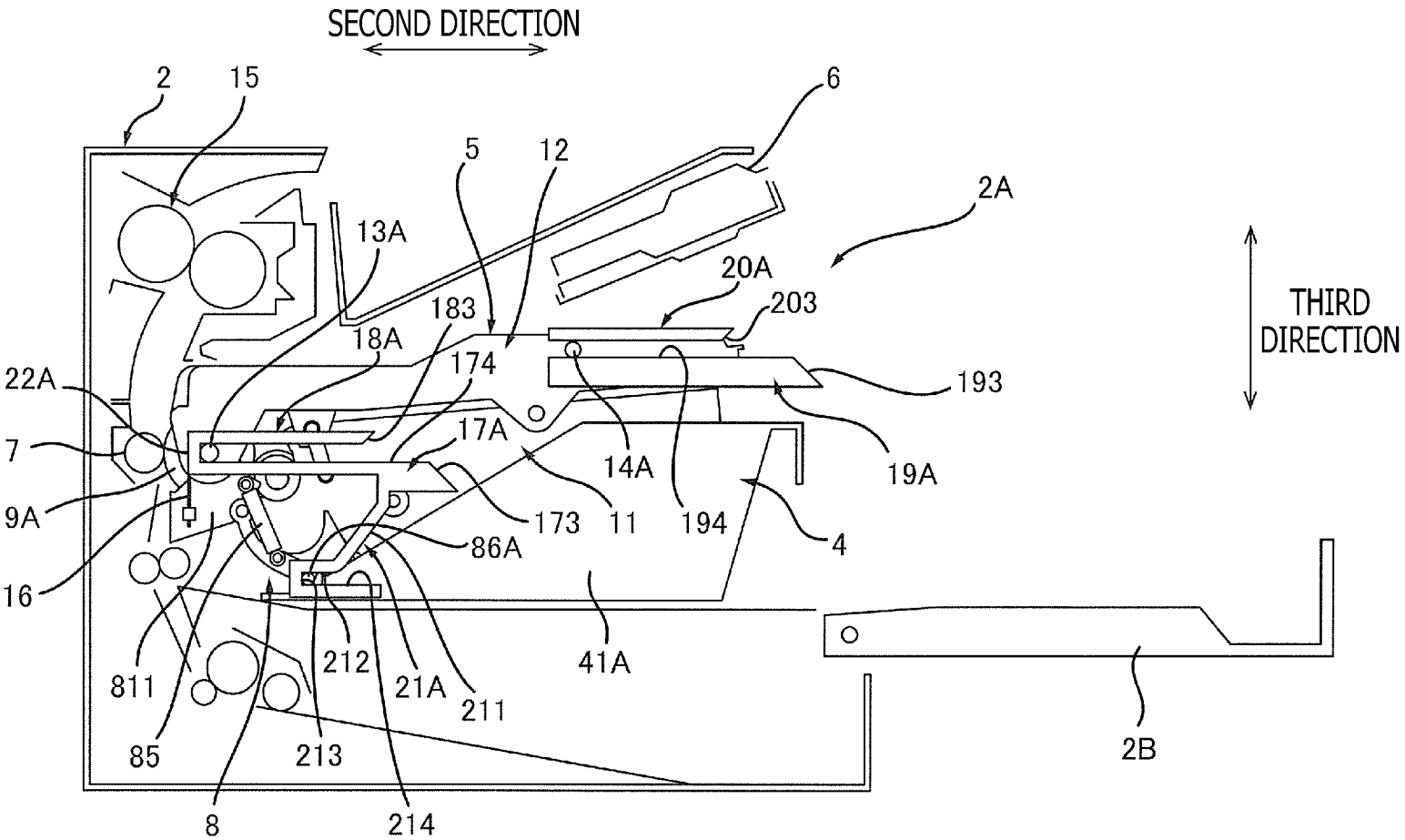
FIG. 8 is a cross-sectional view of the drawer in the image forming apparatus according to the embodiment of the present disclosure with the cartridge mounted thereon located at a position where the first guided portion abuts on an abutting portion.

As shown in FIG. 5, the abutting portion 22A and the abutting portion 2B are located inside the housing 2. As shown in FIG. 8, in the state where the drawer 4 with the cartridge 5 mounted thereon is located at the inner position, the abutting portion 22A and the abutting portion 22B (see FIG. 5) contact the cartridge 5.

In this arrangement, in the state where the drawer 4 with the cartridge 5 mounted thereon is located at the inner position, the photosensitive drum 9 may be located at a correct position with respect to the housing 2.

In particular, in the state where the drawer 4 with the cartridge 5 mounted thereon is located at the inner position, the abutting portion 22A abuts the first guided portion 13A. The abutting portion 22A connects the first guide 17A and the first stopper 18A. The abutting portion 22A extends in the third direction.

Meanwhile, as shown in FIG. 5, in the state where the drawer 4 with the cartridge 5 mounted thereon is located at the inner position, the abutting portion 22B abuts the first guided portion 13B (see FIG. 4). The abutting portion 22B connects the first guide 17B and the first stopper 18B. The abutting portion 22B extends in the third direction.

4.4 Second Guides 19A, 19B

The second guide 19A and the second guide 19B are located inside the housing 2. As shown in FIGS. 6 and 7, the second guide 19A and the second guide 19B may guide the cartridge 5, when the drawer 4 with the cartridge 5 mounted thereon moves from the outer position to the inner position, along with the first guide 17A and the first guide 17B (see FIG. 5).

In this arrangement, the drawer 4 with the cartridge 5 mounted thereon may be moved from the outer position to the inner position smoothly.

In particular, when the drawer 4 with the cartridge 5 mounted thereon moves from the outer position to the inner position, the second guide 19A may guide the second guided portion 14A. The second guide 19A is located apart from the first guide 17A in the second direction. The second guide 19A is located on a side of the first guide 17A opposite to the transfer roller 7 in the second direction. The second guide 19A extends in the second direction. The second guide 19A includes a third guiding face 193 and a fourth guiding face 194.

As shown in FIG. 6, the third guiding face 193 is located at an end of the second guide 19A in the second direction. The third guiding face 193 is located on a side of the fourth guiding face 194 opposite to the first guide 17A in the second direction. The third guiding face 193 may, when the drawer 4 with the cartridge 5 mounted thereon moves from the outer position to the inner position, contact the second guided portion 14A and guide the second guided portion 14A to the fourth guiding face 194. The third guiding face 193 inclines with respect to the second direction. In particular, the third guiding face 193 inclines upward as the third guiding face 193 extends toward the fourth guiding face 194.

As shown in FIG. 7, the fourth guiding face 194 adjoins the third guiding face 193 in the second direction. The fourth guiding face 194 is continuous with the third guiding face 193. The fourth guiding face 194 extends in the second direction. The fourth guiding face 194 may be an upward face of the second guide 19A. The fourth guiding face 194 may, when the drawer 4 with the cartridge 5 mounted thereon moves from the outer position to the inner position, contact the second guided portion 14A from a lower position.

The second guide 19B as shown in FIG. 4 may guide the second guided portion 14B when the drawer 4 with the cartridge 5 mounted thereon moves from the outer position to the inner position. The second guide 19B is located apart from the second guide 19A in the first direction. The form of the second guide 19B may be described in the same manner as the second guide 19A.

4.5 Second Stoppers 20A, 20B

The second stopper 20A and the second stopper 20B are located inside the housing 2. As shown in FIG. 7, the second stopper 20A and the second stopper 20B (see FIG. 5) may, in the state where the drum cover 8 contacts the contacting portion 21A and the contacting portion 21B (see FIG. 5), restrict the cartridge 5 from derailing or separating from the second guide 19A and the second guide 19B (see FIG. 5), respectively.

In particular, the second stopper 20A may, when the drawer 4 with the cartridge 5 mounted thereon moves from the outer position to the inner position, stop the second guided portion 14A from separating from the second guide 19A. The second stopper 20A is, when the drawer 4 with the cartridge 5 mounted thereon moves from the outer position to the inner position, located on a side of the second guided portion 14A opposite to the second guide 19A while the second guided portion 14A is in contact with the fourth guiding face 194. The second stopper 20A is located apart from the fourth guiding face 194 in the third direction. A distance between the fourth guiding face 194 and the second stopper 20A in the third direction may be equal to an outer diameter of the second guided portion 14A. The second stopper 20A may face the fourth guiding face 194 from an upper position.

The second stopper 20A extends in the second direction. The second stopper 20A has a second oblique face 203, which is located at an end of the second stopper 20A in the second direction. The second oblique face 203 is located between the third guiding face 193 and the first guide 17A in the second direction. The second oblique face 203 inclines with respect to the second direction. The second oblique face 203 inclines downward as the second oblique face 203 extends toward the first guide 17A in the second direction.

The second stopper 20B as shown in FIG. 4 may, when the drawer 4 with the cartridge 5 mounted thereon moves from the outer position to the inner position, stop the second guided portion 14B from leafing from the second guide 19B. The second stopper 20B is, when the drawer 4 with the cartridge 5 mounted thereon moves from the outer position to the inner position, located on a side of the second guided portion 14B opposite to the second guide 19B while the second guided portion 14B is in contact with the fourth guiding face 194. The second stopper 20B is located apart from the second stopper 20A in the first direction. The form of the second stopper 20B may be described in the same manner as the second stopper 20A.

4.6 Contacting Portions 21A, 21B

The contacting portion 21A and the contacting portion 21B are located inside the housing 2. As shown in FIGS. 7 and 8, the contacting portion 21A and the contacting portion 21B (see FIG. 5) may, when the cartridge 5 is being guided by the first guide 17A and the first guide 17B (see FIG. 5), contact the drum cover 8 to move the drum cover 8 from the first position to the second position. When the drum cover 8 moved from the first position is located the second position, the first cover 811 of the drum cover 8 is located at a position on a side of the photosensitive drum 9 opposite to the first stopper 18A in the third direction.

As shown in FIG. 7, the contacting portion 21A may, when the drawer 4 with the cartridge 5 mounted thereon moves from the outer position to the inner position, contact the protrusion 86A. The contacting portion 21A is located on a side of the first guide 17A opposite to the first stopper 18A in the third direction. The contacting portion 21A is located at a lower position with respect to the first guide 17A. The contacting portion 21A is located between the first guiding face 173 and the abutting portion 22A in the second direction. The contacting portion 21A is continuous with the first guide 17A. The contacting portion 21A is located at a same position as the first guide 17A in the first direction (see FIG. 4). The contacting portion 21A may be a rib. The contacting portion 21A includes a first contacting face 211, a second contacting face 212, a third contacting face 213, and a fourth contacting face 214.

The first contacting face 211 inclines with respect to the second direction. The first contacting face 211 extends toward the abutting portion 22A in the second direction as the first contacting face 211 extends away from the first guide 17A in the third direction.

The second contacting face 212 is continuous with the first contacting face 211. The second contacting face 212 is located on a side of the first contacting face 211 opposite to the first guiding face 173 in the second direction. The second contacting face 212 is located on a side of the first contacting face 211 opposite to the first guide 17A in the third direction. The second contacting face 212 extends in the second direction.

The third contacting face 213 is continuous with the second contacting face 212. The third contacting face 213 is located on a side of the second contacting face 212 opposite to the first contacting face 211 in the second direction. The third contacting face 213 is located on a side of the second contacting face 212 opposite to the first contacting face 211 in the third direction. The third contacting face 213 extends in the vertical direction.

The fourth contacting face 214 is continuous with the third contacting face 213. The fourth contacting face 214 faces the second contacting face 213 in the third direction. The fourth contacting face 214 extends in the second direction.

The first contacting face 211, the second contacting face 212, the third contacting face 213, and the fourth contacting face 214 each contact the protrusion 86A when the drawer 4 with the cartridge 5 mounted thereon moves from the outer position to the inner position.

In particular, the protrusion 86A may, when the drawer 4 with the cartridge 5 mounted thereon moves from the outer position to the inner position, contact or collide with the first contacting face 211 and move along the first contacting face 211. Thereby, the protrusion 86A may be moved to be away in the third direction from the first guided portion 13A, which is being guided by the first guide 17A. Accordingly, the second cover 812 may pivot against the contracting force of the spring 85 such that the protrusion 86A may move away from the photosensitive drum 9.

Thus, the spring 85 may stretch and pull the first cover 811, as shown in FIG. 8. Thereby, the first cover 811 may move to a side of the first guided portion 13A opposite to the first stopper 18A in the third direction against the contracting force of the spring 85. As a result, the drum cover 8 may be moved to from the first position to the second position.

Thereafter, the protrusion 86A may reach a position between the second contacting face 212 and the fourth contacting face 214 and contact the second contacting face 212. Due to the contact between the protrusion 86A and the second contacting face 212, the drum cover 8 may be maintained at the second position. Thus, while the drawer 4 with the cartridge 5 mounted thereon is at the inner position, the protrusion 86A may stay contacting the second contacting face 212 and the third contacting face 213.

On the other hand, when the drawer 4 with the cartridge 5 mounted thereon moves from the inner position to the outer position, the protrusion 86A may move along the first contacting face 211 to be closer to the first guided portion 13A in the third direction. Therefore, the second cover 812 may pivot by the contracting force of the spring 85 such that the protrusion 86A may move closer to the photosensitive drum 9. As a result, as shown in FIG. 7, the spring 85 may recover from the stretched form, and the first cover 811 may be moved by the contracting force of the spring 16 to cover the part 9A of the photosensitive drum 9. As a result, the drum cover 8 may move from the second position to the first position.

When the drawer 4 with the cartridge 5 mounted thereon moves from the outer position to the inner position, the contacting portion 21B as shown in FIG. 4 may contact the protrusion 86B. The contacting portion 21B is located apart from the contacting portion 21A in the first direction. The contacting portion 21B is located at the same position as the first guide 17B in the first direction. The form of the contacting portion 21B may be described in the same manner.

5. Benefits (1) According to the image forming apparatus 1 described above, when the cartridge 5 is detached from the image forming apparatus 1, as shown in FIG. 3A, the drum cover 8 is located at the first position. Therefore, the photosensitive drum 9 may be protected while the cartridge 5 is detached from the image forming apparatus 1.

When the drawer 4 with the cartridge 5 mounted thereon moves from the outer position to the inner position, as shown in FIG. 7, the cartridge 5 may be guided by the first guide 17A. While the cartridge 5 is guided by the first guide 17A, the contacting portion 21A may contact the drum cover 8. In this arrangement, the contacting portion 21A may be placed to stay in contact with the drum cover 8 stably.

Therefore, when the drawer 4 with the cartridge 5 mounted thereon moves from the outer position to the inner position, the drum cover 8 at the first position may be moved to the first position reliably.

(2) According to the image forming apparatus 1 described above, when the drawer 4 with the cartridge 5 mounted thereon moves from the inner position to the outer position, as shown in FIG. 7, the drum cover 8 may move from the second position to the first position. Therefore, in the state where the drawer 4 is located at the outer position, the drum cover 8 may be located at the first position reliably.

(3) According to the image forming apparatus 1 described above, as shown in FIG. 3A, the spring 16 may pull the drum cover 8 in the direction from the second position toward the first position. Therefore, while the cartridge 5 is detached from the drawer 4, the drum cover 8 may be located at the first position stably.

(4) According to the image forming apparatus 1 described above, when the drawer 4 with the cartridge 5 mounted thereon moves from the outer position to the inner position, as shown in FIG. 7, the second guide 19A may, along with the first guide 17A, guide the cartridge 5. Thus, the drawer 4 with the cartridge 5 mounted thereon may be moved from the outer position to the inner position smoothly.

(5) According to the image forming apparatus 1 described above, as shown in FIG. 7, the second guided portion 14A is located apart from the first guided portion 13A in the second direction. The contacting portion 21A may reach to contact the drum cover 8 while the first guided portion 13A is being guided by the first guide 17A and the second guided portion 14A is being guided by the second guide 19A. Therefore, the cartridge 5 may be stabilized in a correct posture, and the contacting portion 21A may be placed to contact the drum cover 8 stably.

(6) According to the image forming apparatus 1 described above, as shown in FIG. 7, the first stopper 18A may restrict the cartridge 5 from separating from the first guide 17A when the drum cover 8 is contacting the contacting portion 21A. Therefore, when the drawer 4 with the cartridge 5 mounted thereon moves from the outer position to the inner position, and when the drum cover 8 is contacting the contacting portion 21A, the cartridge 5 may be restrained from separating from the first guide 17A. Thus, the cartridge 5 may be guided by the first guide 17A reliably, and the drum cover 8 may be restrained from separating from the contacting portion 21A.

(7) According to the image forming apparatus 1 described above, in the state where the drum cover 8 is located at the second position, as shown in FIG. 1, the second cover 812 is located between the cartridge 5 and the bottom plate 42. Therefore, the drum cover 8 may be located at the second position by use of the space between the bottom plate 42 and the photosensitive drum 9. Thus, the image forming apparatus 1 may be restrained from increasing in the size thereof.

(8) According to the image forming apparatus 1 described above, in the state where the cartridge 5 is mounted on the drawer 4, as shown in FIG. 4, the side plate 41A of the drawer 4 is located between the developer housing 11A and the tip end E1 of the protrusion 86A in the first direction. In other words, the tip end E1 of the protrusion 86A is located on the side of the side plate 41A opposite to the developing housing 11A in the first direction. In this arrangement, the tip end E1 of the protrusion 86A may be placed to contact the contacting portion 21A reliably.

6. More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described examples of modifications to the present embodiment.

For example, the image forming apparatus 1 may not necessarily have the first stoppers 18A, 18B. For another example, the image forming apparatus 1 may not necessarily have the second stoppers 20A, 20B.

For another example, the cartridge 5 may have three (3) of the first guided portion 13A, the first guided portion 13B, the second guided portion 14A, and the second guided portion 14B rather than all of the four (4) guided portions 13A, 13B, 14A, 14B. In this arrangement, the posture of the cartridge 5 may still be stabilized when the drawer 4 with the cartridge 5 mounted thereon moves from the outer position to the inner position.

In these modified arrangements, the benefits achievable by the image forming apparatus 1 in the embodiment described above may be similarly achieved.

What is claimed is:

1. An image forming apparatus, comprising:

a housing;

a cartridge, including:

a photosensitive drum rotatable about an axis, the axis extending in a first direction; and a drum cover movable with respect to the photosensitive drum between a first position, in which the drum cover covers a part of the photosensitive drum, and a second position, in which the part of the photosensitive drum is exposed;

a drawer, on which the cartridge is mountable, the drawer being movable in a second direction, the second direction intersecting with the first direction, between an inner position, in which the drawer is located inside the housing, and an outer position, in which the drawer is located outside the housing;

a first guide located inside the housing, the first guide being configured to guide the cartridge when the drawer with the cartridge mounted thereon moves from the outer position to the inner position; and a contacting portion located inside the housing, the contacting portion being configured to contact the drum cover and move the drum cover from the first position to the second position in a state where the cartridge is being guided by the first guide, wherein the cartridge includes a developer housing configured to store toner;

wherein the drum cover includes:

a cover body extending in the first direction; and a protrusion located at an end of the cover body in the first direction, the protrusion extending in the first direction, the protrusion being configured to contact the contacting portion; and wherein the drawer includes a side plate, the side plate being located between the developer housing and a tip end of the protrusion in the first direction in a state where the cartridge is mounted on the drawer.

2. The image forming apparatus according to claim 1, wherein the drum cover is configured to move from the second position to the first position when the drawer with the cartridge mounted thereon moves from the inner position to the outer position.

3. The image forming apparatus according to claim 1, wherein the cartridge includes a spring configured to pull the drum cover in a direction from the second position toward the first position.

4. The image forming apparatus according to claim 1, further comprising:

a second guide located inside the housing, the second guide being located apart from the first guide, the second guide being configured to guide the cartridge along with the first guide when the drawer with the cartridge mounted thereon moves from the outer position to the inner position.

5. The image forming apparatus according to claim 4, wherein the cartridge includes:

a first guided portion, at which the cartridge is guided by the first guide; and a second guided portion, at which the cartridge is guided by the second guide, the second guided portion being located apart from the first guided portion.

6. The image forming apparatus according to claim 1, further comprising:

a stopper configured to stop the cartridge from separating from the first guide when the drum cover is in contact with the contacting portion.

7. The image forming apparatus according to claim 6, wherein the contacting portion is located on a side of the first guide opposite to the stopper in a third direction, the third direction intersecting orthogonally with the first direction and the second direction.

8. The image forming apparatus according to claim 7, wherein the drum cover moved from the first position to the second position is located at a position on a side of the photosensitive drum opposite to the stopper in the third direction.

9. The image forming apparatus according to claim 1, wherein the contacting portion is a rib.

10. The image forming apparatus according to claim 1, wherein the drawer includes a bottom plate; and wherein, in a state where the drawer with the cartridge mounted thereon is located at the inner position, the drum cover located at the second position is located between the cartridge and the bottom plate.

11. The image forming apparatus according to claim 1, further comprising a transfer roller, wherein the photosensitive drum is located between the side plate and the transfer roller in the second direction in a state where the drawer with the cartridge mounted thereon is located at the inner position.

12. The image forming apparatus according to claim 1, wherein the housing includes an opening, through which the drawer moves when the drawer moves between the inner position and the outer position;

wherein the housing includes a cover movable between a closure position, in which the cover closes the opening, and an open position, in which the opening is open;

wherein the image forming apparatus further comprises a transfer roller; and wherein the cartridge is located between the transfer roller and the cover in the second direction in a state where the drawer with the cartridge mounted thereon is located at the inner position and the cover is located at the closure position.

* * * * *